United States Patent [19]

Zabel et al.

[11] 4,422,311

[45] Dec. 27, 1983

[54] PADLOCK

[75] Inventors: Herbert E. Zabel, Wheaton; William Lelyk, Roselle, both of Ill.

[73] Assignee: American Home Products Corporation, New York, N.Y.

[21] Appl. No.: 366,545

[22] Filed: Apr. 8, 1982

[51] Int. Cl.[3] ..... E05B 37/10; E05B 67/22

[52] U.S. Cl. ..... 70/25; 70/38 B

[58] Field of Search ..... 70/25, 38 B, 21, 22, 70/24, 38 R, 38 A, 38 C, 51

[56] References Cited

U.S. PATENT DOCUMENTS

| | | | |
|---|---|---|---|
| 2,893,231 | 7/1959 | Soref | 70/25 |
| 3,194,033 | 7/1965 | Markert | 70/38 B |
| 3,990,275 | 11/1976 | Lippisch | 70/25 |
| 4,055,972 | 11/1977 | Calegan | 70/21 |
| 4,170,884 | 10/1979 | Calegan | 70/21 |

*Primary Examiner*—Robert L. Wolfe

*Attorney, Agent, or Firm*—Robert D. Teichert

[57] ABSTRACT

A padlock having a latching mechanism comprising a spring-biased latch bolt slidably disposed within a housing and having its free end extending outwardly from the housing to a locking position. The latch bolt has two upstanding spaced-apart shoulder portions, one shoulder portion being outside the housing positioned to engage the housing and prohibit sliding movement of the latch bolt into the housing, with the other shoulder portion being inside the housing and cooperating with the housing to maintain the one outside shoulder in its position to engage the housing. The latch bolt is pivotable about the inside shoulder portion to move the outside shoulder portion out of its position to engage the housing and thus permit the latch bolt to slide into the housing.

3 Claims, 9 Drawing Figures

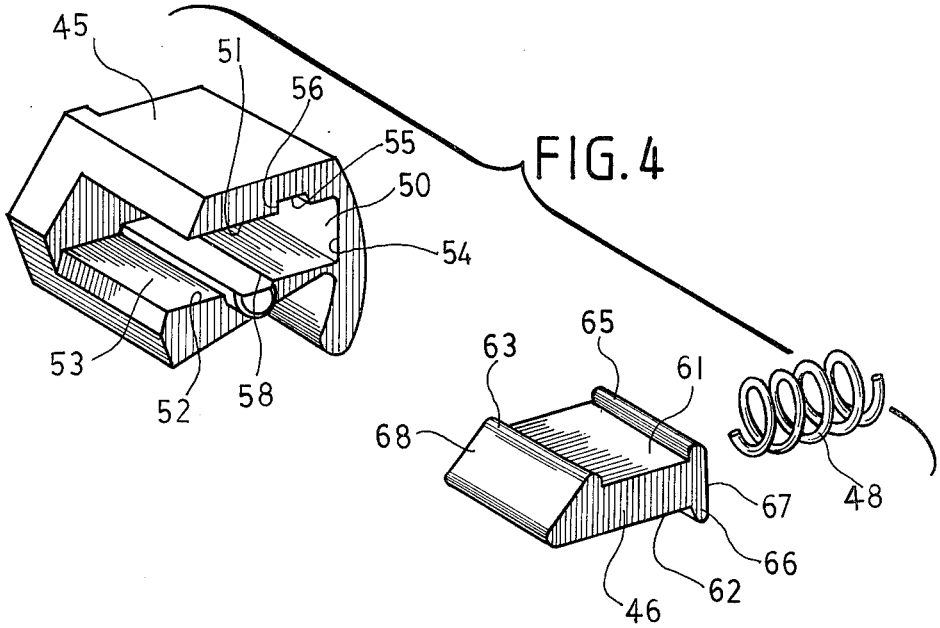
FIG. 4
FIG. 8
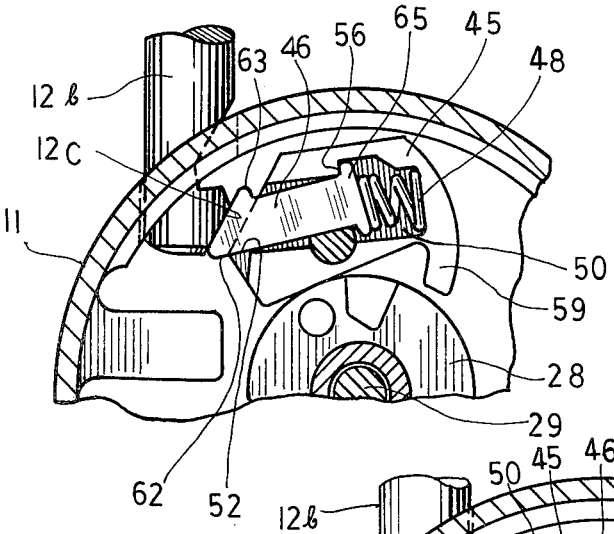
FIG. 7
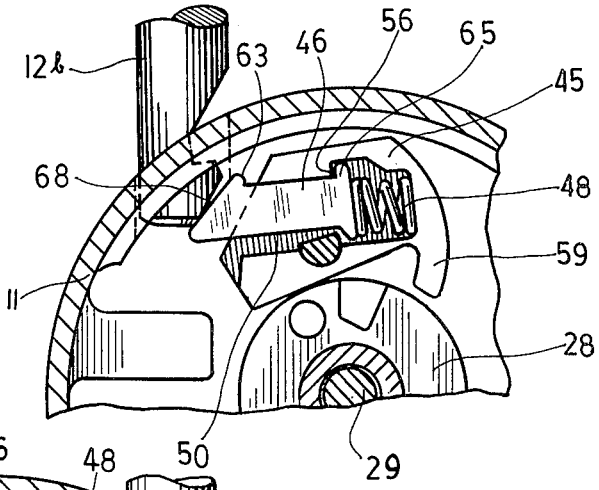
FIG. 9
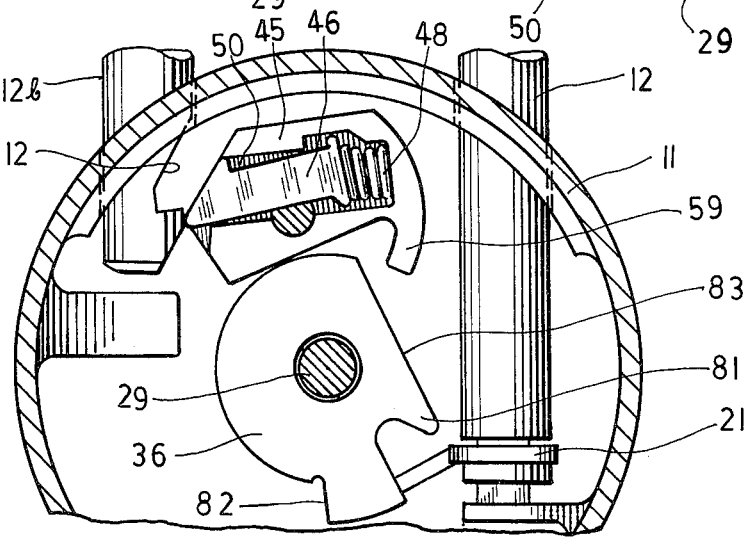

PADLOCK

BACKGROUND OF THE INVENTION

This invention relates to padlocks, and more particularly to the latch mechanism which functions to lock and release the padlock shackle.

All padlocks, whether of the permutation type, the key operated type, or of the combination permutation and key operated type, necessarily include a latch mechanism which, at one time functions to hold the padlock shackle in its locked position, and at another time functions to release the shackle for movement to its open position. The latch mechanism has become more or less standardized in that a spring-biased latch bolt slidably carried in a pivoted rocker engages a notch formed in the padlock shackle. This engagement of the latch bolt in the shackle notch prevents upward movement of the shackle to its open position.

Means well known and established in the art are utilized to disengage the latch bolt from the shackle notch by pivoting the rocker, as in permutation type padlocks, or by sliding the latch bolt into the rocker, as in key operated padlocks. Such disengagement permits upward movement of the shackle to its open position whereupon the latch bolt is slidably returned to its original disposition. Downward movement of the shackle to a locked position involves moving the shackle against the latch bolt and sliding the latch bolt back into the rocker until the shackle notch is aligned with the latch bolt, whereupon the latch bolt slides into engagement with the shackle notch.

As described, after the latch mechanism functions to unlock the padlock, the spring-biased latch bolt returns to its original disposition automatically and will then interact with the shackle to relock the padlock without subsequent manipulation of the padlock key or the padlock combination dial. Unfortunately, the advantages afforded by the spring-biased latch bolt are somewhat offset by the disadvantage that such a latch bolt is subject to forceful and manipulative tampering designed to open this type of padlock. A sharp blow against the padlock casing with simultaneous or repetitive tapping of the padlock shackle in a particular manner can cause the latch bolt to move into the rocker sufficiently to permit upward movement of the shackle, thus "springing" or opening the padlock.

The present invention is designed to overcome the tampering aspect of this type of padlock by providing means to limit or restrict the sliding movement of the latch bolt in the rocker.

SUMMARY OF THE INVENTION

With the above background in mind, it is the object of this invention to provide a latching mechanism utilizing a spring-biased latch bolt slidably disposed within a rocker wherein the latch bolt has limited sliding movement into the rocker when the padlock shackle is interlocked with the latch bolt. Specifically, the latch bolt must be prevented from sliding into the rocker and disengaging the shackle except when such disengagement is accomplished through manipulation of a padlock key.

To this end, a latch bolt having parallel top and bottom flat surfaces with two spaced-apart shoulder portions extending upwardly from the top surface is slidably mounted in a recess in the rocker member. One of the two shoulder portions is disposed outside of the rocker recess while the other shoulder portion is disposed in an enlarged portion of the recess within the rocker. The said other shoulder portion acts as a fulcrum in cooperation with associated spring means to urge the top surface of the latch bolt into abutment with the top wall of the recess, whereby said one shoulder portion disposed outside of the rocker acts as a stop to prevent the latch bolt from sliding into the rocker recess.

DESCRIPTION OF THE DRAWINGS

FIG. 4 is an exploded perspective view of the spring-biased latch bolt and rocker assembly comprising the latch mechanism.

FIG. 7 is a fragmentary vertical sectional view similar to FIG. 6 but showing the shackle moved downwardly into the padlock body.

FIG. 8 is a view similar to FIG. 7 showing the latch bolt pivoted by the downward movement of the shackle.

FIG. 9 is a view similar to FIG. 8 showing the latch bolt slid into the rocker by further downward movement of the shackle.

DESCRIPTION OF A PREFERRED EMBODIMENT

Figure 1:
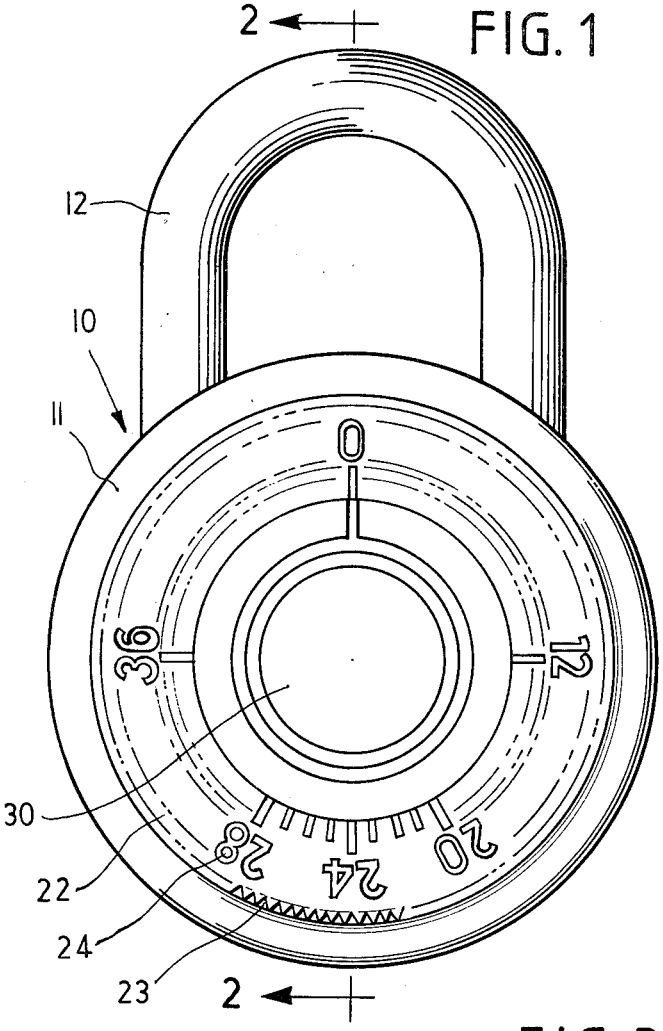
FIG. 1 is a front elevational view of a padlock embodying the teachings of the invention set forth herein.
Figure 2:
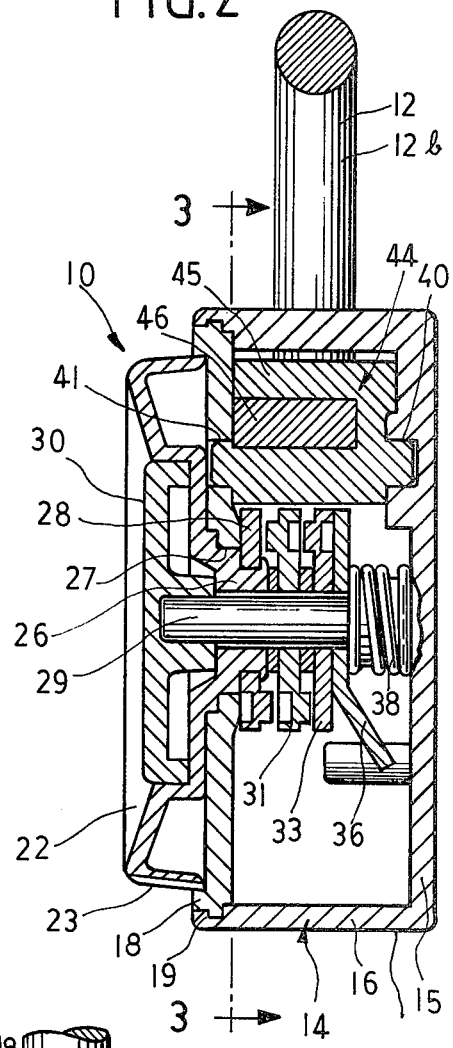
FIG. 2 is a vertical sectional view taken along lines 2—2 of FIG. 1.
Figure 3:
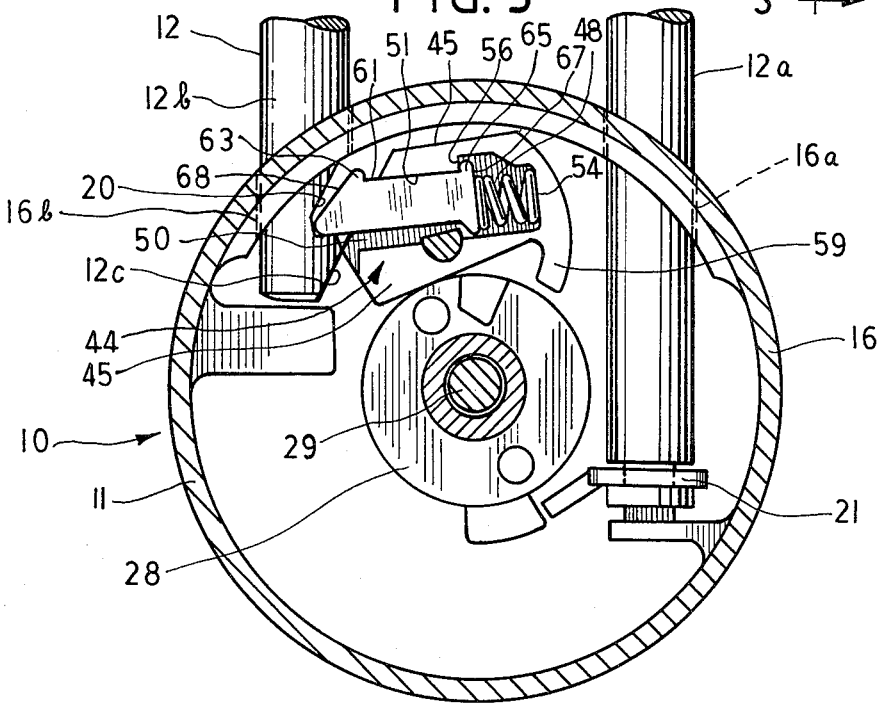
FIG. 3 is a vertical sectional view taken along lines 3—3 of FIG. 2 showing the latching mechanism in "locked" position.

Referring now to the drawings and specifically to FIGS. 1, 2, and 3, the reference numeral 10 indicates a padlock comprising a body member 11 and a shackle 12. The body member 11 is comprised of a cylindrically shaped shell 14 having a back wall 15 and side wall 16, and a front plate 18 secured to said side wall by a rolled over flange as indicated at 19. The shackle 12 is u-shaped having a long leg **12*a* and a short leg 12*b* extending through side wall openings 16*a* and 16*b*, respectively. The short leg 12*b* has a locking notch 20 formed therein adjacent its terminus, which terminus has a bevel or cam surface 12*c*, and the long leg 12*a* has a guide member 21** secured thereto at its terminus, the functions of which will be described later.

A circular dial 22 having a knurled outer wall 23 and the numerical markings indicated by reference numeral 24 has a hollow stem portion 26 extending through an opening 27 in the shell front plate 18 to abutment with and securement to a first disc member 28. A shaft 29 formed integral with the back wall 15 extends through the hollow stem 26 thereby providing an axle about which the dial 22 can be rotated and has a cap member 30 press-fitted thereon. A second disc 31 and a third disc 33 rotatably mounted on shaft 29 can be rotated by and in coordination with the first disc 28 in a manner well known in the art to align peripheral notches in the discs, as indicated by reference numeral 35 in FIG. 5. Inasmuch as the construction and operation of the dial and disc assembly is all conventional and, as such, does not constitute a part of the invention disclosed herein, no detailed description is necessary for a complete understanding of said invention. Also mounted on shaft 29 is a disc upsetter 36 and a compression spring 38, the function of both to be described later.

Referring to FIG. 2, a journal 40 formed in the back wall 15 is aligned with a similar journal 41 formed in the front plate 18, and together they provide bearing surfaces for a rotatable locking mechanism 44 mounted therein and disposed between the back wall and front plate. The locking mechanism 44 comprises a housing member or rocker 45, a latch bolt 46, and a spring 48 which, as shown, function as a unitary element to maintain the padlock in a locked position, as will now be described.

As shown in FIGS. 3 and 4, the rocker 45 is formed to provide a recess 50 therein having parallel top and bottom walls, 51 and 52, respectively, defining an opening 53, and a back wall 54. The top wall 51 is formed to provide an enlarged portion 55 in the recess 50 remote from said opening 53 defining a ledge 56, and the bottom wall 52 is formed to provide an upstanding stop member 58 in approximate vertical alignment with said ledge 56. An arcuate tongue 59 extending outwardly and downwardly from the rocker 45 in diametric opposition to the recess opening 53 is disposed adjacent the peripheries of discs 28, 31 and 33, the purpose for which will be described later.

The latch bolt 46, best seen in FIG. 4, has parallel top and bottom flat surfaces 61 and 62, respectively. The top surface 61 has two spaced-apart shoulder portions extending upwardly therefrom, one shoulder portion being designated by the reference numeral 63 and the other shoulder portion being designated by the reference numeral 65. The bottom surface 62 has a shoulder portion 66 extending downwardly therefrom which is connected to the other shoulder portion 65 of the top surface 61 by a flat vertical back wall 67. The one shoulder portion 63 of the top surface 61 is connected to the bottom wall 62 by an inclined front wall 68.

Referring again to FIG. 3 a spring 48 disposed between the back wall 54 of the recess 50 and the back wall 67 of the latch bolt 46 urges the latch bolt out of the recess 50 so that front wall 68 of said latch bolt is disposed within the locking notch 20 of the shackle 12. This bias of spring 48 against back wall 67 moves the shoulder portion 65 of latch bolt 46 into abutment with ledge 56 of rocker 45 which acts as a fulcrum to pivot the latch bolt 46 upwardly so that the latch bolt top surface 61 abuts the top wall 51 of the rocker recess 50. In this condition, forceful and manipulative tampering cannot move the latch bolt 46 out of engagement with locking notch 20 since shoulder portion 63 cooperates with the rocker 45 to limit sliding movement of the latch bolt 46 into the recess 50. Not only is the shackle 12 locked by the latch bolt 46, but latch bolt 46 is locked by the rocker 45, thus effecting a "double-lock" for the padlock.

As shown, any movement of the shackle 12 upwardly will cause locking notch 20 to apply upward pressure against latch bolt 46 thereby urging rotation of rocker 45 in a clockwise direction. However, such rotation will move the tongue 59 into abutment with the peripheral portions of discs 28, 31 and 33 thereby preventing further rotation of the rocker 45, and thereby maintaining the interlocking relationship between shackle notch 20 and latch bolt 46.

Figure 5:
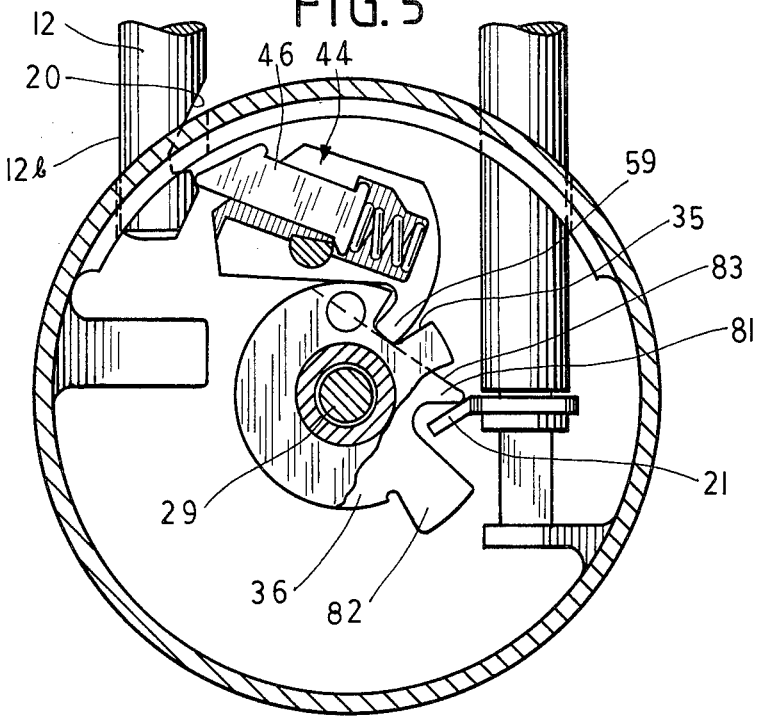
FIG. 5 is a vertical sectional view similar to FIG. 3 but showing rotation of the latch mechanism to an "unlocked" position and with portions of the disc members broken away.

Manipulation of dial 22 through a correct combination has, in a well known manner and as shown in FIG. 5, rotated the discs 28, 31 and 33 to align peripheral notches in the discs, as indicated by reference numeral 35. Movement of shackle 12 upwardly moves shackle notch 20 upwardly against latch bolt 46 causing clockwise rotation of the locking mechanism 44, such rotation being permitted since the aligned notches 35 allow tongue 59 to move past the periphery of discs 28, 31 and 33. This is an "unlocked" position of the locking mechanism 44 and permits the shackle short leg **12*b* to be moved upwardly and out of locking engagement with the latch bolt 46. As shown, the disc upsetter 36 has a short lever arm 81 and a long lever arm 82 which bracket the shackle guide 21, and the upward movement of shackle 12 also moves shackle guide 21 upwardly against the upsetter short lever arm 81 thereby rotating upsetter 36** counter-clockwise.

Figure 6:
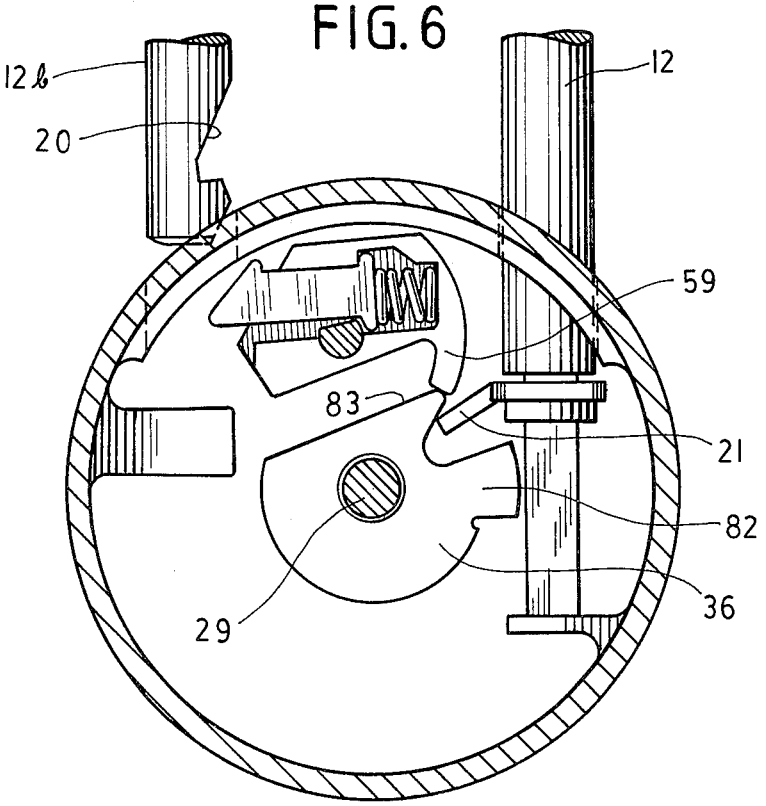
FIG. 6 is a view similar to FIG. 5 but with the disc members completely broken away and showing the shackle approaching an open position.

As shown in FIG. 6, continued movement of the shackle 12 upwardly continues the rotation of upsetter 36 causing the cam surface 83 to act against the tongue 59 thereby rotating the rocker in a counter-clockwise direction and back to its original locking engagement disposition. After the tongue 59 has been cammed out of the aligned notches 35 of the discs 28, 31 and 33 as described, further movement of the shackle 12 upwardly and out of the body member 11 will further rotate upsetter 36 and, as will now be explained, cause rotation of disc 33.

As seen in FIG. 2, compression spring 38 places an axial thrust on upsetter 36 urging it into contact with disc 33. This contact or frictional engagement causes disc 33 to be rotated along with rotation of upsetter 36 except when disc 33 is otherwise engaged, as by the tongue 59. Rotation of disc 33 by upsetter 36 is independent of discs 28 and 31 and, accordingly, such rotation moves the notch of disc 33 out of alignment with the notches of discs 28 and 31.

Referring now to FIGS. 7, 8 and 9, there is shown, in sequence, the action between the shackle leg **12*b* and the latch bolt 46 as the shackle 12 is moved downwardly from the open position to a locked position. As shown in FIG. 7, downward movement of the shackle 12 places shackle leg 12*b* into abutment with the inclined wall 68 of latch bolt 46. Continued downward movement of shackle 12 pivots the latch bolt 46 downwardly about the fulcrum formed by shoulder portion 65 and ledge 56, to the position shown in FIG. 8, wherein the bottom surface 62 of the latch bolt abuts the bottom wall 52 of the recess 50. Continued downward movement of shackle 12 causes the shackle cam surface 12*c* to act against the latch bolt inclined wall 68 and slide the latch bolt 46 into the recess 50 of the rocker 45 as shown in FIG. 9. As also seen in FIG. 9, the downward movement of the shackle 12 has moved the shackle guide 21 downwardly against upsetter arm 82 thereby rotating upsetter 36 clockwise towards return to its initial position. Further downward movement of shackle 12 aligns the locking notch 20 with the recess 50 and permits movement of the spring-biased latch bolt 46 into locking engagement with said locking notch, as shown in FIG. 3**.

While I have described my invention in terms of a permutation type lock it is, of course, equally applicable to a key operated lock. There are many styles of key operated lever arrangements that can be utilized to manipulate the latching mechanism 44 to remove the latch bolt 46 from locking engagement with the locking notch 20, but since they are not necessary to the invention, nor to understanding the invention, they are considered the equivalent of the permutation style of unlocking the padlock. Whether permutation type, key type, or a combination of these, the invention is directed to improving the security of a padlock whose shackle is held in a locked position by a spring-biased bolt member.

Having described my invention in terms of a preferred embodiment, it should be obvious that modifications are possible within the teachings described herein without departing from the scope of the invention as hereinafter claimed.

What is claimed is:

1. A padlock comprising a body member having shackle leg receiving openings therein, a shackle having legs slidable in said openings, one of said shackle legs having a notch therein, a shackle bolt having an end portion adapted to cooperate with said shackle leg notch so as to effect the locking and unlocking of the shackle, a bolt housing positioned within said body member and provided with a recess to slidably accommodate the shackle bolt therein, spring means arranged within said recess to urge the shackle bolt outwardly whereby to dispose said shackle bolt end portion into locking engagement with said shackle leg notch, said shackle bolt having two upstanding spaced apart shoulder portions, one shoulder portion being disposed outside the housing and positioned to engage the housing so as to prohibit sliding movement of the shackle bolt into the housing, the other shoulder portion being disposed within the bolt housing recess, means formed in said recess cooperating with said other shoulder portion to maintain said one shoulder portion in its position to engage the housing, and means for moving said shackle bolt out of locking engagement with said shackle leg notch and returning the shackle bolt to locking engagement disposition after the shackle leg notch is removed from said locking engagement disposition.

2. A padlock according to claim 1 wherein downward movement of the shackle bolt end portion displaces the one shoulder portion of the shackle bolt from its position to engage the housing and thereby permits sliding movement of the shackle bolt into the housing recess.

3. A padlock according to claim 2 wherein the means formed in said recess cooperating with said other shoulder portion comprises a ledge against which the other shoulder portion of the shackle bolt is urged and which acts as a fulcrum for said shackle bolt.

* * * * *